US010418015B2

(12) United States Patent
Valeri et al.

(10) Patent No.: US 10,418,015 B2
(45) Date of Patent: Sep. 17, 2019

(54) SYSTEM FOR SPECTRAL SHAPING OF VEHICLE NOISE CANCELLATION

(71) Applicant: GM GLOBAL TECHNOLOGY OPERATIONS LLC, Detroit, MI (US)

(72) Inventors: Frank C. Valeri, Novi, MI (US); Christopher A. Stirlen, Milford, MI (US); Timothy J. Roggenkamp, Brighton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/722,475

(22) Filed: Oct. 2, 2017

(65) Prior Publication Data

US 2019/0103087 A1 Apr. 4, 2019

(51) Int. Cl.

| | |
|---|---|
| ***G10K 11/00*** | (2006.01) |
| ***G10K 11/178*** | (2006.01) |
| ***H04R 3/00*** | (2006.01) |

(52) U.S. Cl.

CPC ..... *G10K 11/002* (2013.01); *G10K 11/178* (2013.01); *H04R 3/002* (2013.01); *H04R 3/005* (2013.01); *G10K 2210/1282* (2013.01)

(58) Field of Classification Search

CPC ..... G10K 11/002; G10K 11/178; G10K 2210/1282; H04R 3/002; H04R 3/005

USPC ..... 381/71.4, 86

See application file for complete search history.

(56) References Cited

U.S. PATENT DOCUMENTS

2005/0084115 A1* 4/2005 Enamito ..... G10K 11/178 381/71.7

2009/0058633 A1* 3/2009 Luo ..... G10K 11/178 340/538.12

* cited by examiner

*Primary Examiner* — Vivian C Chin
*Assistant Examiner* — Douglas J Suthers

(57) ABSTRACT

The present disclosure is directed to a system and a method for spectral shaping of vehicle noise cancellation. In an example implementation, the method includes determining a center frequency of an expected tonal peak within a selected noise band based upon vehicle data, generating a noise cancellation signal using a weighted shaping filter to shape the noise band, and outputting the noise cancellation signal to smooth the expected tonal peak.

19 Claims, 8 Drawing Sheets

SYSTEM FOR SPECTRAL SHAPING OF VEHICLE NOISE CANCELLATION

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to shaping vehicle noise, and more particularly to a system and method to shape tonal noises by way of noise cancellation signals.

During operation, drivers and passengers experience noises that may be undesirable. For example, vehicles are subject to road noise caused by defects in the road. In other examples, vehicles generate known noises, or tones, at expected frequencies based upon the vehicle attributes, such as tire size, tire cavity, and/or speed of the vehicle.

SUMMARY

In an example, a vehicle noise shaping system is disclosed. In an example implementation, the vehicle noise shaping system includes a tonal noise monitoring module that determines a center frequency of an expected tonal peak within a selected noise band based upon vehicle data and determines whether (1) a difference between a decibel value of the expected tonal peak within the selected noise band and a root mean square value of the selected noise band or (2) a ratio between the decibel value of the expected tonal peak within the selected noise band and the root mean square value of the selected noise band exceeds a predetermined threshold. The vehicle noise shaping system also includes a noise shaping module that uses a weighted shaping filter to generate a noise cancellation signal when the difference or the ratio exceeds the predetermined threshold to shape the noise band. The vehicle noise shaping system also includes an audio output module that is configured to output the noise cancellation signal to smooth the expected tonal peak when the difference or the ratio exceeds the predetermined threshold.

In other features, the vehicle noise shaping system the vehicle noise shaping system also includes an attribute adjustment module that determines whether the tonal peak is within a predetermined frequency range when the difference or the ratio does not exceed the predetermined threshold and adjusts a vehicle attribute when the tonal peak is within the predetermined frequency range.

In other features, the tonal noise monitoring module calculates the difference between the decibel value of the expected tonal peak and the root mean square value of the selected noise band or the ratio of the decibel value of the expected tonal peak and the root mean square value of the selected noise band.

In other features, the audio output module outputs the noise cancellation signal to one or more speakers when the difference or the ratio exceeds the predetermined threshold. In other features, the tonal noise monitoring module receives the vehicle data from one or more vehicle sensors. In other features, the tonal noise monitoring module selects the center frequency of the expected tonal peak based upon the vehicle data. In other features, the vehicle data represents a speed of a vehicle, a temperature associated with the vehicle, or a vibration associated with the vehicle. In other features, the noise shaping module selects filtering weights according to the difference or the ratio to shape the noise cancellation signal according to the selected filtering weights. In other features, the weighted shaping filter comprises a bandpass filter, a bandstop filter, a high-pass filter, or a low-pass filter.

In an example, a system is disclosed. The system includes an active noise cancellation module that receives a signal indicative of environmental noise within a vehicle cabin and generates a noise cancellation signal based upon the signal. The system also includes a tonal noise cancellation module in communication with the active noise cancellation module. The tonal noise cancellation module includes a tonal noise monitoring module that is configured to determine a center frequency of a tonal peak within a selected noise band based upon the signal and a noise shaping module that uses a weighted shaping filter to generate a noise cancellation signal to shape the noise band. The tonal noise cancellation module also includes an audio output module that outputs the noise cancellation signal to smooth the tonal peak.

In other features, the audio output module outputs the noise cancellation signal to one or more speakers disposed within a vehicle cabin.

In an example, a method is disclosed. The method includes determining a center frequency of an expected tonal peak within a selected noise band based upon vehicle data, generating a noise cancellation signal using a weighted shaping filter to shape the noise band, and outputting the noise cancellation signal to smooth the expected tonal peak.

In other features, the method also includes determining whether (1) a difference between a decibel value of the expected tonal peak within the selected noise band and a root mean square value of the selected noise band or (2) a ratio between the decibel value of the expected tonal peak within the selected noise band and the root mean square value of the selected noise band exceeds a predetermined threshold, generating the noise cancellation signal using the weighted shaping filter when the difference or the ratio exceeds the predetermined threshold, and outputting the noise cancellation signal to smooth the expected tonal peak when the difference or the ratio exceeds the predetermined threshold.

In other features, the method includes calculating the difference between the decibel value of the expected tonal peak and the root mean square value of the selected noise band or the ratio of the decibel value of the expected tonal peak and the root mean square value of the selected noise band. In other features, the method includes outputting the noise cancellation signal to one or more speakers when the difference or the ratio exceeds the predetermined threshold.

In other features, the method includes receiving the vehicle data from one or more vehicle sensors. In other features, the method includes selecting the center frequency of the expected tonal peak based upon the vehicle data. In other features, the vehicle data represents a speed of a vehicle, a temperature associated with the vehicle, or a vibration associated with the vehicle. In other features, the method includes selecting filtering weights according to the difference or the ratio to shape the noise cancellation signal according to the selected filtering weights. In other features, the weighted shaping filter comprises at least one of a bandpass filter, a bandstop filter, a high-pass filter, and a low-pass filter Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A system and method according to the present disclosure shapes tonal noise by applying weighting filters to the cancellation output signal in order to modify the overall perception of the tonal noises naturally present within the vehicle. Current noise cancellation systems, such as active noise cancellation systems (i.e., road noise cancellation systems) provide reduction in broad band noise by reducing the noise signal over the frequency band. However, these noise cancellation systems may not reduce tonal peaks to the broad band noise floor. Thus, an occupant of the vehicle may still experience these tonal peaks even after the noise signal was reduced. The system and method described herein may improve the overall perceptibility of the tonal peaks by applying a shaping filter to the tonal peak portion of the cancellation signal (i.e., noise cancellation signal). For example, the system and method can shape the peak portion to reduce the decibel level experienced by the occupants as compared to other vehicle noise cancellation systems.

The system and method can include a tonal noise monitoring module that determines a center frequency of an expected tonal peak within a selected noise band based upon vehicle data and determines whether a difference between a decibel value of the expected tonal peak and a root mean square value of the selected noise band or a ratio between the decibel value of the expected tonal peak and the root mean square value of the selected noise band exceeds the predetermined threshold. The system and method can also include a noise shaping module that applies a shaping filter to a noise band including the tonal peak when the difference exceeds the predetermined threshold to shape the noise band. The system and method also includes an audio output module that outputs the filtered noise band when the tone exceeds the predetermined parameter.

Figure 1:
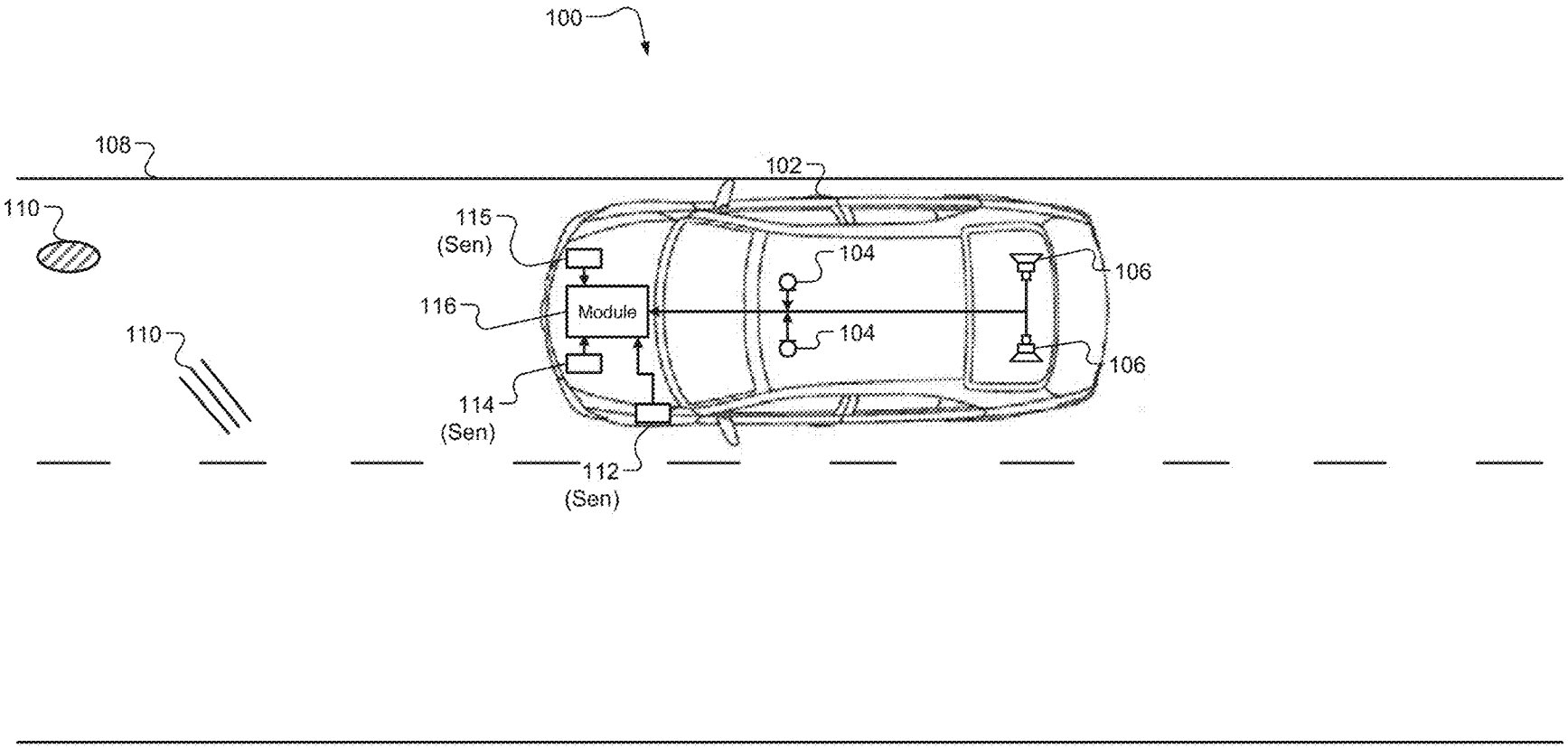
FIG. 1 is diagrammatic illustration of a vehicle including a vehicle noise shaping system in accordance with an example implementation of the present disclosure.

FIG. 1 illustrates a vehicle environment 100 in accordance with an example implementation of the present disclosure. The vehicle environment 100 includes a vehicle 102. As shown, the vehicle 102 includes one or more microphones 104 and one or more speakers 106. The microphones 104 detect sound within the vehicle 102 cabin. The speakers 106 generate various sounds within the vehicle 102 and/or outside of the vehicle 102. For example, the speakers 106 emit sound waves having approximately the same amplitude but with an inverted phase (i.e., antiphase) to at least partially cancel the noise detected by the microphones. The microphones 104 can be deployed throughout the vehicle 102 to capture sound that occupants can hear. The speakers 106 may be deployed throughout the interior, such as in the doors, the rear shelf, and/or the roof, of the vehicle 102 to cancel noise detected by the microphones 104.

In an example, a roadway 108 traveled by vehicles, such as the vehicle 102, may include roadway defects 110, such as damaged asphalt and the like. While traveling the roadway 108, the vehicle 102 may encounter the roadway defects 110, which can result in undesired noise detectable by the microphones 104. As described in greater detail herein, the speakers 106 can generate audio that reduces the perceptibility of the undesired sound to the drivers and/or passengers of the vehicle 102.

The vehicle 102 includes one or more sensors that measure vehicle data. For example, the vehicle 102 can include a wheel speed sensor 112 mounted to one or more wheels of the vehicle 102 and measures the speed of the wheels. The vehicle 102 can also include a temperature sensor 114 that measures a temperature. For example, the temperature sensor can measure a temperature of one or more tires of the vehicle 102, an ambient temperature, and/or an engine temperature. The vehicle 102 can also include a vibrational sensor 115 that is configured to measure one or more vibrations corresponding to the vehicle 102. For example, the vibrational sensor 115 can measure vibrations experienced by the vehicle 102 when the vehicle 102 travels over a roadway 108 including roadway defects 110.

The vehicle 102 includes a noise cancellation module 116. The noise cancellation module 116 may include an active noise cancellation system that generates signals having approximately the same amplitude as detected noise but having an inverted phase with respect to the detected noise signals. In an implementation, the microphones 104 detect noise and provide data representing the noise to the noise cancellation module 116. The noise cancellation module 116 processes the data and generates a signal that is emitted at the speakers 106 that effectively cancels (i.e., through destructive interference) the noise perceptible within the vehicle 102. For example, the microphones 104 can detect road noise generated by the vehicle 102 traveling over the roadway defects 110, and the noise cancellation module 116 generates sound that effectively cancels the road noise.

Figure 2A:
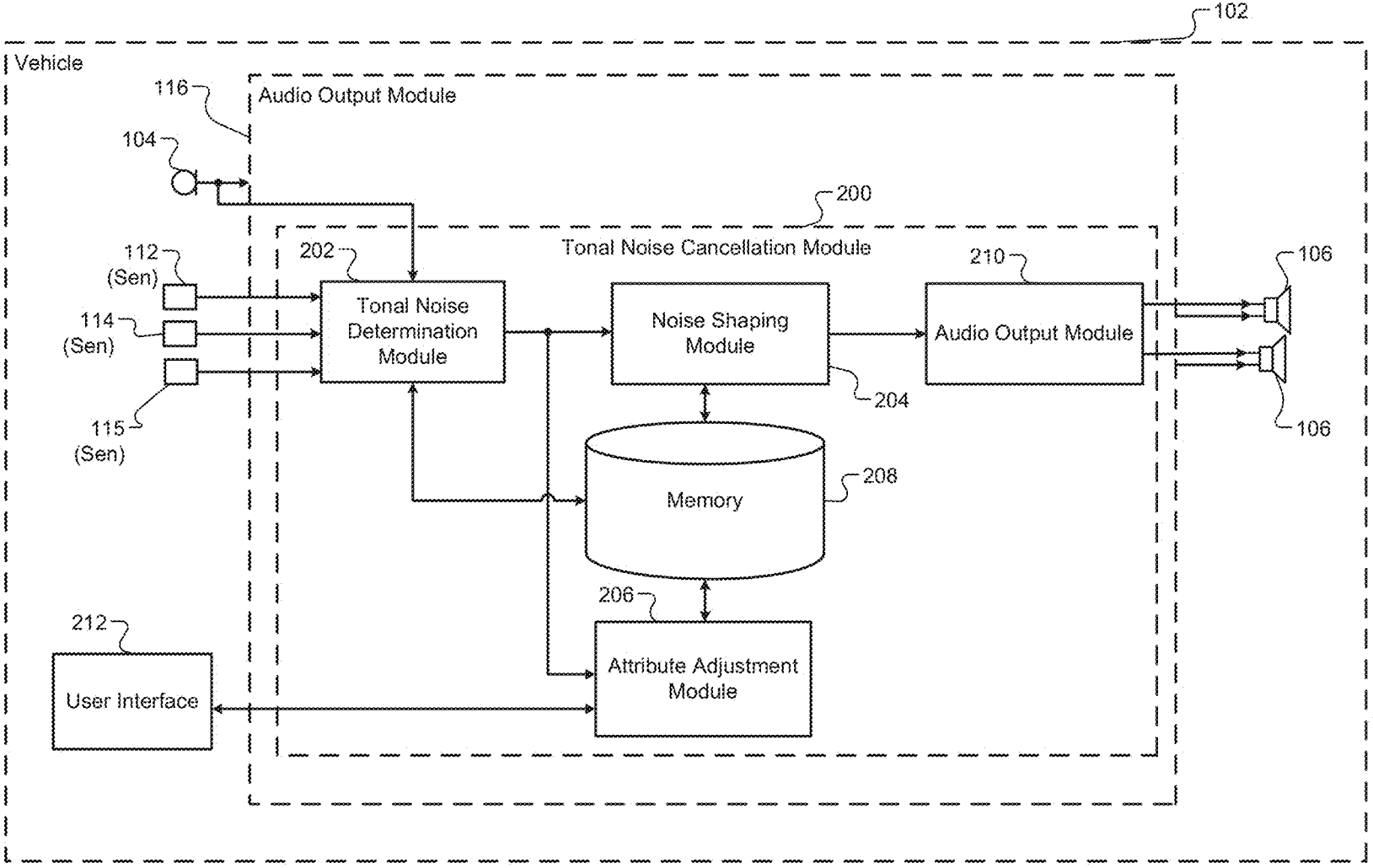
FIG. 2A is block diagram illustrating the vehicle noise shaping system in accordance with an example implementation of the present disclosure.

Referring to FIG. 2A, the noise cancellation module 116 includes a tonal noise cancellation module 200. Tonal noises are wave forms that occur at a single frequency. For example, tonal noises occur at predictable frequencies based upon the vehicle operating environment, such as rotational speeds of drive shafts, number of pistons, speed of the vehicle, tire size, tire cavity size, other mechanical noise sources, and/or audio output. Active noise cancellation systems, such as the noise cancellation module 116, can reduce the overall noise perceptible to occupants of the vehicle 102. However, tonal peaks may still result in undesirable experiences due to the sharp peak perceptible to the occupants.

Figure 2B:
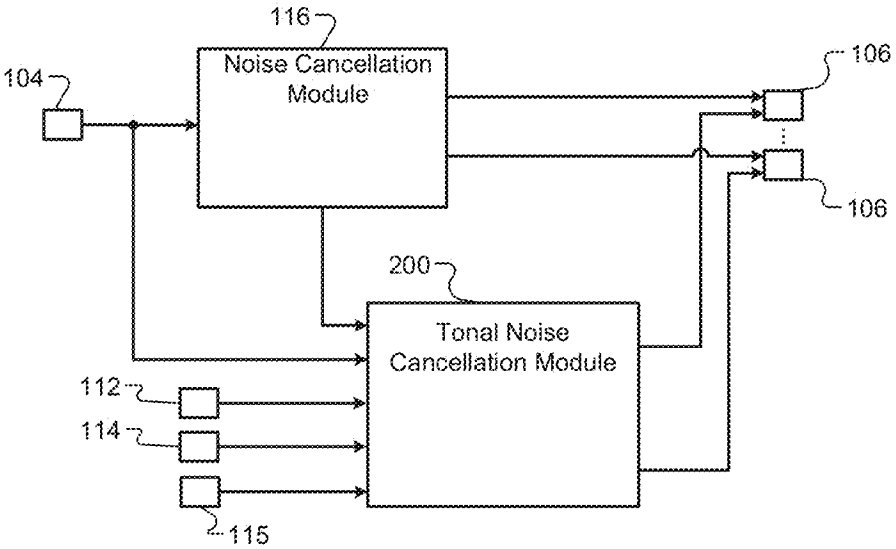
FIG. 2B is another block diagram illustrating the vehicle noise shaping system, where the vehicle shaping system includes a noise cancellation module and a tonal noise cancellation module in accordance with an example implementation of the present disclosure.

FIG. 2B illustrates another example implementation of the vehicle noise cancellation system disclosed herein. The noise cancellation module 116 can operate during operation of the vehicle 102. Upon determining that an expected tonal peak is forthcoming, the tonal noise cancellation module 200 initiates operation to generate a noise cancellation signal to shape the tonal peak noise as described herein. Upon determining the vehicle data has been modified or that the tonal peak cannot be identified, the noise cancellation module 116 initiates operation.

As described in greater detail herein, the tonal noise cancellation module 200 initiates operation based upon the tracked vehicle data. For example, the tonal noise cancellation module 200, using the tracked vehicle data, can determine that a tonal peak is expected at a defined frequency and generate a weighted signal that interferes with the tonal peak at the center frequency of the tonal peak.

The tonal noise cancellation module 200 monitors vehicle data measured by the various sensors, such as the wheel speed sensor 112 and/or the temperature sensor 114. The tonal noise cancellation module 200 also monitors noise detected by the microphones 104. As shown in FIG. 2A, the tonal noise cancellation module 200 includes a tonal noise monitoring module 202, a noise shaping module 204, an attribute adjustment module 206, memory 208, and an audio output module 210.

The tonal noise monitoring module 202 monitors vehicle data and/or noise data. During operation, the tonal noise monitoring module 202 can initiate operation of the tonal noise cancellation module 200 based upon the monitored vehicle data and/or monitored noise. In an implementation, the tonal noise monitoring module 202 receives vehicle data representing vehicle parameters, such as current speed, temperature, vibration, and the like, from the sensors 112, 114, 115 and/or data indicative of measured sound from the microphones 104. The tonal noise monitoring module 202 determines a tonal noise band to monitor based upon the monitored vehicle data. For example, the memory 208 stores expected tonal noise profiles corresponding to various vehicle attributes (i.e., tire size, tire cavity size, engine components, speed, temperature, etc.) and the monitored vehicle data.

The expected tonal noise profiles represent expected tonal peaks within a defined frequency band (i.e., tonal noise band) based upon the vehicle attributes and monitored vehicle data. The expected tonal noise profile may include a look-up table indicating expected tonal peak at a center frequency based upon the vehicle attributes and monitored vehicle data. Thus, the tonal noise monitoring module 202 can initiate a look-up operation based upon the monitored vehicle data to obtain weights for generating an interference signal corresponding to the tonal peak. The tonal noise profile may be pre-populated based upon the vehicle attributes or updated if the vehicle attributes have changed.

For example, a vehicle 102 having a specific speed parameter and/or specific temperature parameter corresponds to an expected tonal peak at a center frequency. If the monitored vehicle data corresponds to the predetermined vehicle attributes, the tonal noise band including the expected center frequency is selected for monitoring. The selected tonal noise band can include a lower tonal noise band limit (i.e., a lower frequency) and an upper tonal noise band limit (i.e., an upper frequency) within a predetermined range of the expected center frequency.

The tonal noise monitoring module 202 monitors the noise data received from at microphones 104 within the selected tonal noise band. In an implementation, the tonal noise monitoring module 202 identifies the expected center frequency within the tonal noise band and calculates a difference between a decibel (dB) value of the tonal noise at the expected center frequency (i.e., expected tonal peak) and a root mean square (RMS) of the tonal noise band. The tonal noise monitoring module 202 then determines whether the difference exceeds a predetermined threshold. Additionally, the tonal noise monitoring module 202 can calculate a ratio between the decibel (dB) value of the tonal noise at the expected center frequency (i.e., expected tonal peak) and the root mean square (RMS) of the tonal noise band.

The noise shaping module 204 initiates shaping filter to generate interference noise focused at the tonal peak to shape the tonal peak when the difference and/or the radio exceeds the predetermined threshold. The shaping filter generates interference noise according to one or more weights to generate a desired noise signal that smoothes the tonal peak as compared to active noise cancellation systems.

For example and as discussed below in reference to FIGS. 3A through 3D, the spectral content of a noise signal at and around the tonal peak may be reduced as compared to the tonal speak reduced by other noise cancellation systems, and the spectral content of other portions (i.e., side bands) of the noise signals may be higher as compared to the noise signal reduced by the other noise cancellation systems.

Figure 3A:
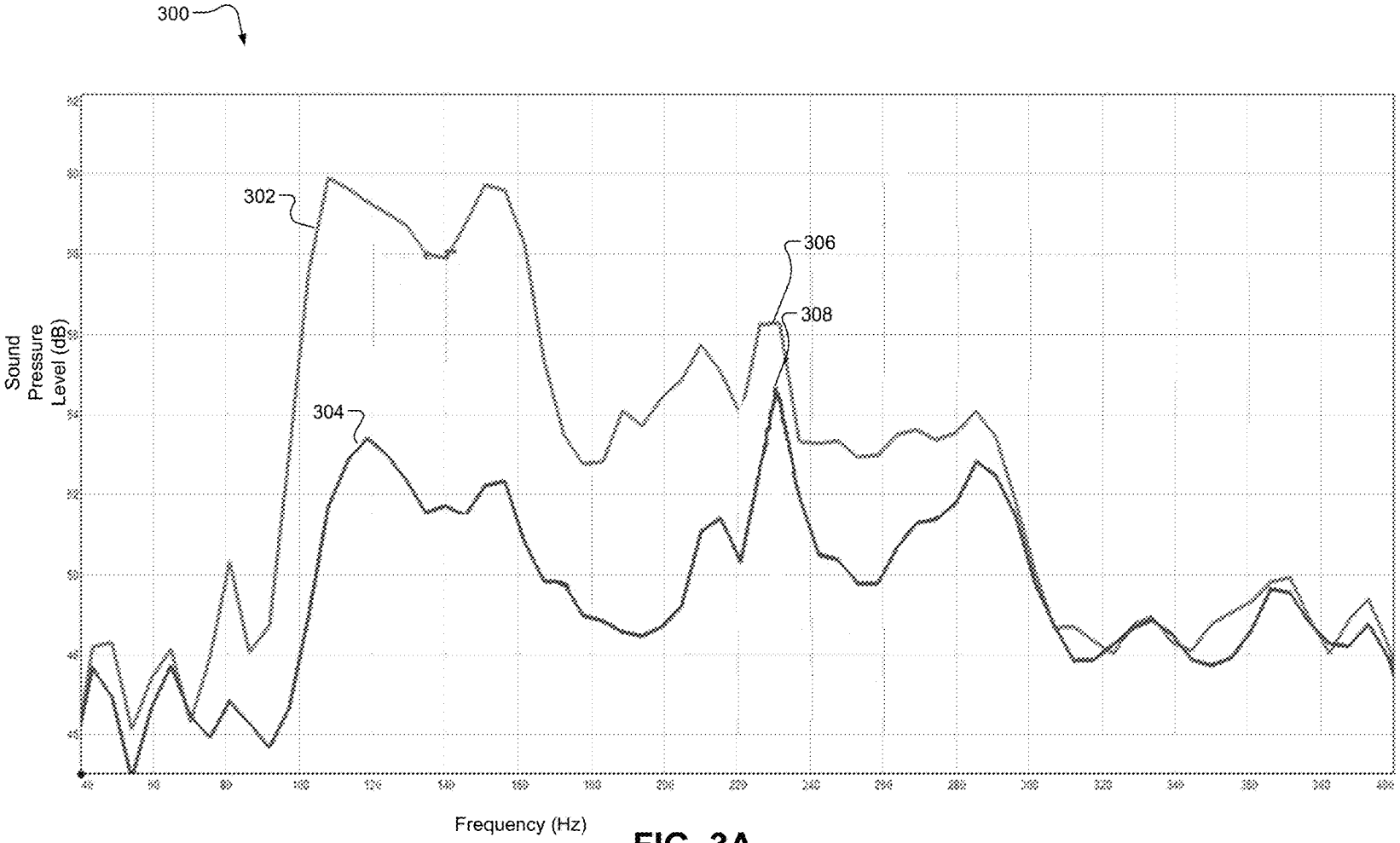
FIG. 3A is a graph illustrating a measured unaltered noise signal and a measured noise signal modified by active noise cancellation systems.
Figure 3B:
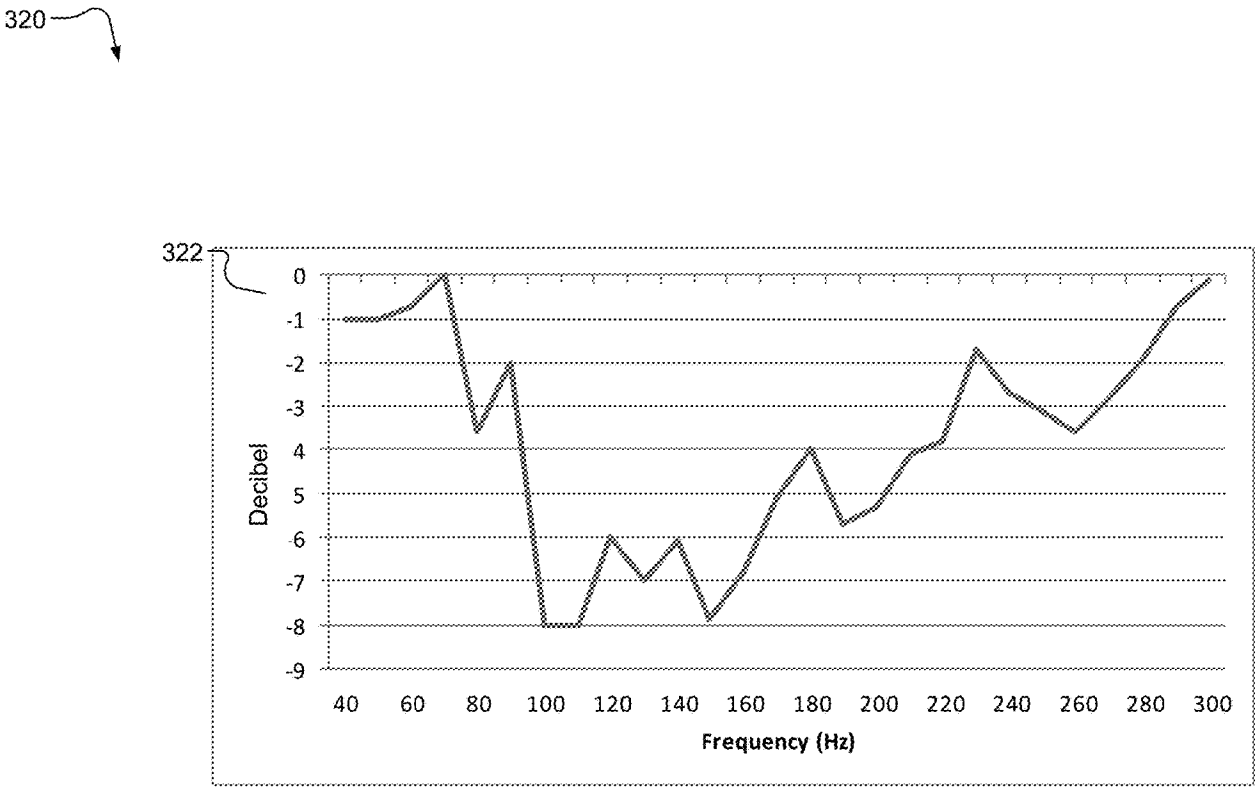
FIG. 3B is a graph illustrating an example noise cancellation signal to reduce the measured unaltered noise of FIG. 3A in accordance with an example implementation of the present disclosure.

FIG. 3A illustrates a graph 300 according to an example implementation of the present disclosure. The graph 300 includes an unaltered noise signal 302 measured over a frequency band. The graph 300 also includes a noise signal 304 altered by active cancellation systems, including road noise cancellation systems. Active noise cancellation system attempt to reduce the spectral content of the noise signal 302 across the whole frequency band by generating the interference noise. The signals 302, 304 includes a respective expected tonal peak 306, 308 occurring at about two hundred and thirty Hertz (230 Hz). FIG. 3B illustrates a graph 320 illustrating a portion of example interference noise signal 322 generated by an active noise cancellation system (i.e., the noise cancellation module 116).

Figure 3C:
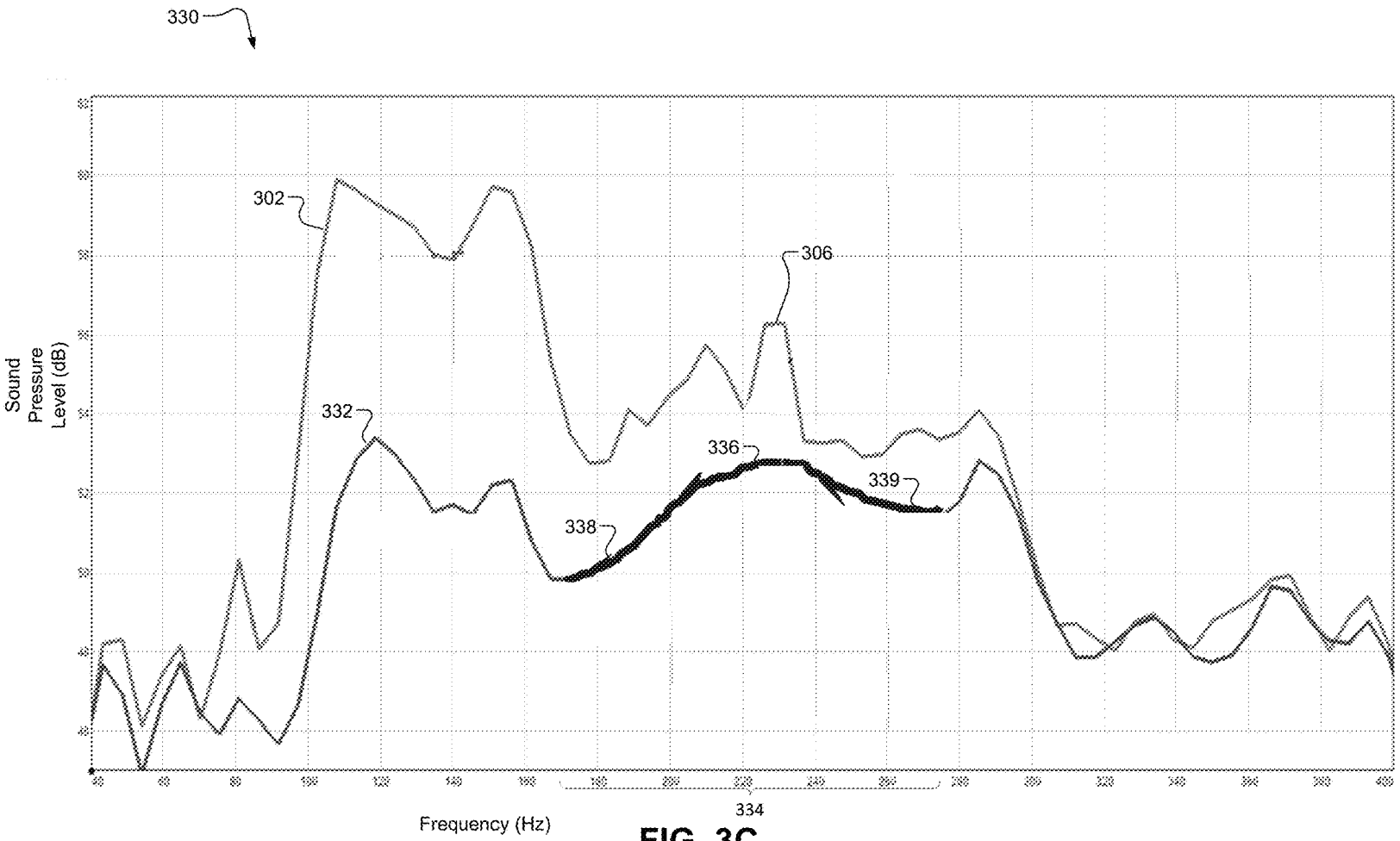
FIG. 3C is a graph illustrating the measured unaltered noise signal and the measured noise signal modified by a noise cancellation system in accordance with an example implementation of the present disclosure.

FIG. 3C illustrates a graph 330 the unaltered noise signal 302 measured over the frequency band and a noise signal 332 alerted by the interference noise signal (see FIG. 3D) generated by the noise shaping module 204. As shown, the unaltered noise signal 302 includes a tonal peak 306. The tonal noise determination module 202 determines the center frequency corresponding to the tonal peak 306 and the corresponding tonal noise band 334 to monitor. In this example, the tonal noise band 334 to monitor ranges from about approximately one hundred and seventy Hertz (170 Hz) (i.e., lower tonal noise band limit) and approximately two hundred and seventy Hertz (270 Hz).

Figure 3D:
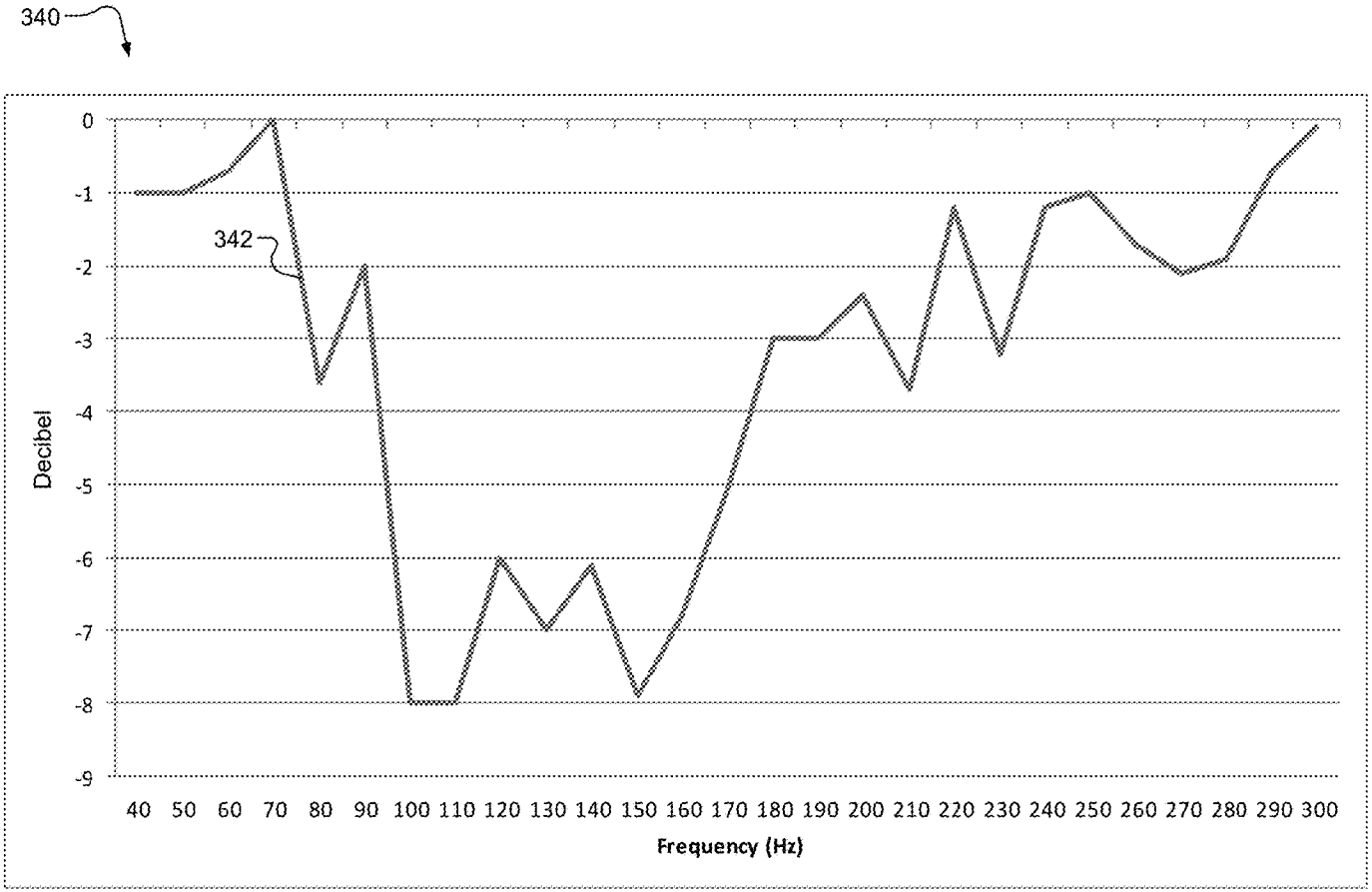
FIG. 3D is a graph is a graph illustrating an example noise cancellation signal generated by the noise cancellation system to reduce the measured unaltered noise of FIG. 3C, where the noise cancellation system uses a shaping filter to generate noise cancellation signals that smooth tonal peaks in accordance with an example implementation of the present disclosure.

The noise shaping module 204 generates the interference signal to shape the corresponding portions of the noise signal 332. As shown, the shaped portion 336 of the noise signal 332 corresponding to the expected tonal peak 306 is smoothed with respect to tonal peak 308 shown in FIG. 3A. However the side band portions 338, 339 of the noise signal 332 have a higher decibel measurement with respect to the corresponding portions of the noise signal 304. FIG. 3D is a graph 340 illustrating an example interference signal 342 generated by the noise cancellation module 116 and the tonal noise cancellation module 200 to interfere with the noise signal 302.

For example, the noise shaping module 204 accesses the memory 208 to obtain corresponding weights to the tonal peak based upon the tonal noise profile. In this example, the noise shaping module 204 applies the weights to shaping filter to generate interference noise about frequencies corresponding to the tonal noise band 334. The energy of the interference noise may be higher around the center frequency (i.e., +/−twenty Hertz (20 Hz)) to shape (i.e., smooth) the tonal peak 306 to the shaped portion 336.

As shown in FIGS. 3B and 3D, the energy of the interference signal around two hundred and thirty Hertz (230 Hz), which is the center frequency of the expected tonal peak, is greater in the interference noise signal 342 as compared to the interference noise signal 322. Additionally, as illustrated in FIGS. 3B and 3D, the energy corresponding to the side bands 338, 339 of the interference signal are generally higher in the interference noise signal 322 as compared to the interference noise signal 342. The interference noise signal 342 shapes the tonal noise band 334 portion of the noise signal 332 to reduce occupant perceptibility of the tonal noise peak. Thus, the weighted shaping filter may cause noise shaping module to generate noise cancellation signals having higher energy at frequencies corresponding to tonal peaks and lower energy at frequencies corresponding to the side bands to shape the noise signals.

The shaping filter may include any number of filters, such as digital filters, that is used to generate noise cancellation signals (i.e., signals that are out of phase with the detected noise signals). For example, the shaping filters may be bandpass filters, bandstop filters, low-pass filters, high-pass filters, or the like, configured to generate interference noise signals.

Referring back to FIG. 2A, once the noise cancellation signal is generated by the noise shaping module 204, the audio output module 210 outputs the noise cancellation signal. For example, the audio output module 210 outputs the noise cancellation signal to the speakers 106 to reduce the perceptibility of the noise.

The attribute adjustment module 206 can adjust the vehicle 102 attributes when the difference does not exceed the predetermined threshold. For example, the attribute adjustment module 206 determines whether the tonal peak is identified within a predetermined range (i.e., ten Hertz (10 Hz), twenty Hertz (20 Hz), etc.) of the center frequency. If the attribute adjustment module 206 determines the tonal peak is within the predetermined range, the attribute adjustment module 206 adjusts one or more vehicle attributes.

For example, based upon the deviation from the expected frequency, the attribute adjustment module 206 can access the memory 208 to retrieve an effective tire size and/or tire cavity corresponding to the deviation. In another example, the attribute adjustment module 206 requests the operator/owner of the vehicle 102 to input the vehicle attributes at a user interface 212. The user interface 212 may be any suitable user interface, such as a touch panel within the vehicle or a mobile electronic device in communication with the vehicle 102. In yet another example, the attribute adjustment module 206 calculates the vehicle attributes, such as the effective tire size and/or tire cavity size. The attribute adjustment module 206 can retrieve a calculation function stored in the memory 208 to calculate the vehicle attributes based upon the deviation. The updated vehicle attributes can be updated in the memory 208 for monitoring purposes.

Figure 4:
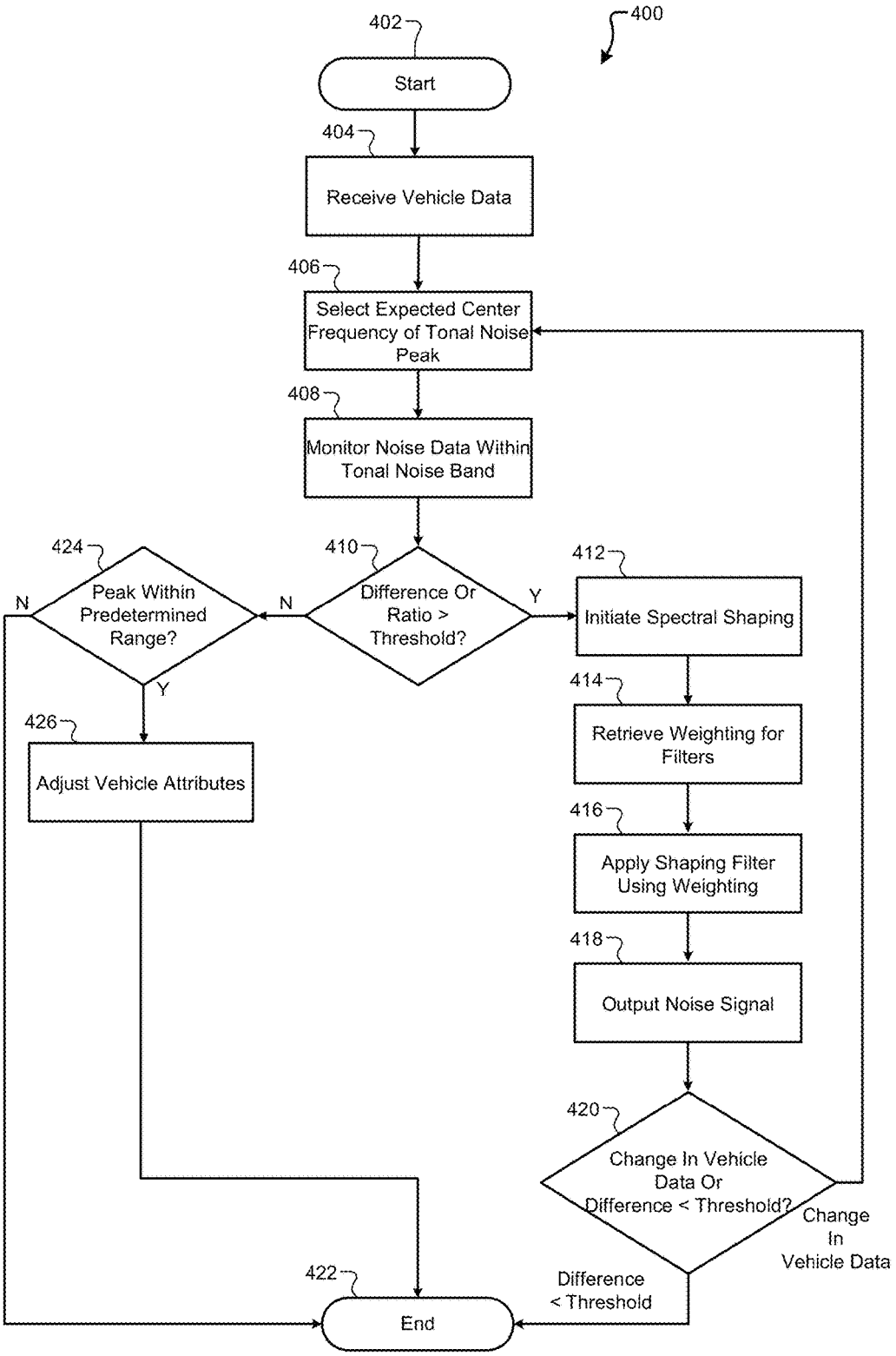
FIG. 4 is a flow diagram illustrating an example method for monitoring tonal noise according to an example implementation of the present disclosure.

FIG. 4 illustrates an example method 400 for monitoring tonal noise associated with the vehicle 102. The method 400 is described in the context of the modules included in the example implementation of the noise cancellation module 116 shown in FIG. 2A. However, the particular modules that perform the steps of the method may be different than those mentioned below and/or the method may be implemented apart from the modules of FIG. 2A.

The method 400 begins at 402. In some implementations, the noise cancellation module 116 is operational and generating noise cancellation signals according to active noise cancellation protocols. At 404, vehicle data is received at the tonal noise monitoring module 202. The vehicle data can include monitored vehicle data including speed, temperature, or the like. At 406, the tonal noise monitoring module 202 selects the expected center frequency of the tonal noise peak based upon the monitored vehicle data and corresponding vehicle attributes. At 408, the tonal noise monitoring module 202 monitors noise data within the tonal noise band. At 410, the tonal noise monitoring module 202 determines whether the difference and/or the ratio between the decibel value corresponding to the center frequency of the expected tonal peak and the root mean square value of the monitored tonal noise band is greater than the predetermined threshold. In implementations, the tonal noise monitoring module 202 calculates the difference and/or the radio and then determines whether the difference and/or the ratio exceed predetermined thresholds.

The noise shaping module 204 initiates spectral shaping of a noise cancellation signal when the difference is greater than the predetermined threshold at 412. At 414, the noise shaping module 204 retrieves the filter weights from the memory 208 based upon the tonal noise band. At 416, the noise shaping module 204 generates the noise cancellation signal using the shaping filter. At 418, the audio output module 210 outputs the noise cancellation signal at the speakers 106.

At 420, the noise shaping module 204 determines whether the vehicle data has changed (i.e., change in speed, change in temperature) or whether the difference is below the predetermined threshold. If vehicle data has changed, the method 400 returns to 406 to identify other potential expected tonal noised based upon the updated vehicle data. If the difference is below the predetermined threshold, the method 400 ends at 422. For instance, the noise cancellation module 116 may initiate active noise cancellation protocols.

If the difference is below the predetermined threshold at 410, the attribute adjustment module 206 determines whether the tonal peak is within a predetermined range of the expected center frequency at 424. If the tonal peak is within the predetermined range, the attribute adjustment module 206 determines the updated vehicle attributes at 426 and stores in the memory 208. If the tonal peak is not within the predetermined range, the method 400 ends at 422.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A vehicle noise shaping system, comprising:

a tonal noise monitoring module that is configured to:

determine a center frequency of an expected tonal peak within a selected noise band based upon vehicle data, and determine whether at least one of (1) a difference between a decibel value of the expected tonal peak within the selected noise band and a root mean square value of the selected noise band and (2) a ratio between the decibel value of the expected tonal peak within the selected noise band and the root mean square value of the selected noise band exceeds a predetermined threshold;

a noise shaping module that is configured to use a weighted shaping filter to generate a noise cancellation signal when at the least one of the difference and the ratio exceeds the predetermined threshold to shape the noise band; and an audio output module that is configured to output the noise cancellation signal to smooth the expected tonal peak when the at least one of the difference and the ratio exceeds the predetermined threshold.

2. The vehicle noise shaping system as recited in claim 1, further comprising:

an attribute adjustment module that is configured to:

determine whether the tonal peak is within a predetermined frequency range when at least one of the difference and the ratio is less than or equal to the predetermined threshold, and adjust a vehicle attribute when the tonal peak is within the predetermined frequency range.

3. The vehicle noise shaping system as recited in claim 1, wherein the tonal noise monitoring module is further configured to calculate at least one of the difference between the decibel value of the expected tonal peak and the root mean square value of the selected noise band and the ratio of the decibel value of the expected tonal peak and the root mean square value of the selected noise band.

4. The vehicle noise shaping system as recited in claim 1, wherein the audio output module is further configured to output the noise cancellation signal to one or more speakers when the at least one of the difference and the ratio exceeds the predetermined threshold.

5. The vehicle noise shaping system as recited in claim 1, wherein the tonal noise monitoring module is further configured to receive the vehicle data from one or more vehicle sensors.

6. The vehicle noise shaping system as recited in claim 1, wherein the tonal noise monitoring module is further configured to select the center frequency of the expected tonal peak based upon the vehicle data.

7. The vehicle noise shaping system as recited in claim 1, wherein the vehicle data represents at least one of a speed of a vehicle, a temperature associated with the vehicle, and a vibration associated with the vehicle.

8. The vehicle noise shaping system as recited in claim 1, wherein the noise shaping module is further configured to select filtering weights according to at least one of the difference and the ratio to shape the noise cancellation signal according to the selected filtering weights.

9. The vehicle noise shaping system as recited in claim 1, wherein the weighted shaping filter comprises at least one of a bandpass filter, a bandstop filter, a high-pass filter, and a low-pass filter.

10. A system comprising:

an active noise cancellation module that is configured to receive an environmental noise signal within a vehicle cabin and to generate a noise cancellation signal based upon the environmental noise signal; and a tonal noise cancellation module in communication with the active noise cancellation module, the tonal noise cancellation module including:

a tonal noise monitoring module that is configured to:

determine a center frequency of an expected tonal peak within a selected noise band based upon the environmental noise signal; and determine whether at least one of (1) a difference between a decibel value of the expected tonal peak within the selected noise band and a root mean square value of the selected noise band and (2) a ratio between the decibel value of the expected tonal peak within the selected noise band and the root mean square value of the selected noise band exceeds a predetermined threshold;

a noise shaping module that is configured to use a weighted shaping filter to generate the noise cancellation signal to shape the noise band when the at least one of the difference and the ratio exceeds the predetermined threshold to shape the noise band; and an audio output module that is configured to output the noise cancellation signal to smooth the expected tonal peak when the at least one of the difference and the ratio exceeds the predetermined threshold.

11. The system as recited in claim 10, wherein the audio output module is configured to output the noise cancellation signal to one or more speakers disposed within a vehicle cabin.

12. A method comprising:

determining a center frequency of an expected tonal peak within a selected noise band based upon vehicle data;

determining whether at least one of (1) a difference between a decibel value of the expected tonal peak within the selected noise band and a root mean square value of the selected noise band and (2) a ratio between the decibel value of the expected tonal peak within the selected noise band and the root mean square value of the selected noise band exceeds a predetermined threshold;

generating a noise cancellation signal using a weighted shaping filter to shape the noise band when at least one of the difference and the ratio exceeds the predetermined threshold; and outputting the noise cancellation signal to smooth the expected tonal peak when the at least one of the difference and the ratio exceeds the predetermined threshold.

13. The method as recited in claim 12, further comprising calculating at least one of the difference between the decibel value of the expected tonal peak and the root mean square value of the selected noise band and the ratio of the decibel value of the expected tonal peak and the root mean square value of the selected noise band.

14. The method as recited in claim 12, further comprising outputting the noise cancellation signal to one or more speakers when at least one of the difference and the ratio exceeds the predetermined threshold.

15. The method as recited in claim 12, further comprising receiving the vehicle data from one or more vehicle sensors.

16. The method as recited in claim 12, further comprising selecting the center frequency of the expected tonal peak based upon the vehicle data.

17. The method as recited in claim 12, wherein the vehicle data represents at least one of a speed of a vehicle, a temperature associated with the vehicle, and a vibration associated with the vehicle.

18. The method as recited in claim 12, further comprising selecting filtering weights according to at least one of the difference and the ratio to shape the noise cancellation signal according to the selected filtering weights.

19. The method as recited in claim 12, wherein the weighted shaping filter comprises at least one of a bandpass filter, a bandstop filter, a high-pass filter, and a low-pass filter.

* * * * *